169-45 SR

6/2/81 OR 4,270,612

United States Patent [19]

Larsson

[11] 4,270,612

[45] Jun. 2, 1981

[54] METHOD FOR PREVENTING THE SPONTANEOUS COMBUSTION OF STORED ORGANIC AND INORGANIC SUBSTANCES

[75] Inventor: Carl Larsson, Kisa, Sweden

[73] Assignee: Kisa Tra AB, Kisa, Sweden

[21] Appl. No.: 24,176

[22] Filed: Mar. 26, 1979

Related U.S. Application Data

[63] Continuation of Ser. No. 719,928, Sep. 2, 1976, abandoned.

[51] Int. Cl.[3] ..... A62C 2/00

[52] U.S. Cl. ..... 169/45; 169/60; 169/70; 169/12; 239/271; 239/553.5

[58] Field of Search ..... 239/135, 271, 553.5, 239/562; 62/129, 293, 294, 373; 73/368; 169/11, 12, 45, 54, 46

[56] References Cited

U.S. PATENT DOCUMENTS

| | | | |
|---|---|---|---|
| 392,844 | 11/1888 | Best | 239/271 X |
| 477,875 | 6/1892 | Vickers | 239/271 X |
| 846,211 | 3/1907 | Johnson | 239/271 X |
| 1,295,166 | 2/1919 | Hoffman | 239/271 |
| 2,229,235 | 1/1941 | Adams | 239/271 X |
| 2,297,872 | 10/1942 | Carter et al. | 251/77 |
| 2,543,362 | 2/1951 | Getz | 169/45 |
| 2,548,621 | 4/1951 | Rutledge | 239/271 |
| 2,730,405 | 1/1956 | Stoops | 239/553.5 X |
| 2,757,744 | 8/1956 | Malone | 169/47 |
| 3,103,296 | 9/1963 | Gour | 169/12 X |
| 3,334,820 | 8/1967 | Flynn | 239/553.5 X |
| 3,856,087 | 12/1974 | Wartes | 169/45 |
| 3,990,517 | 11/1976 | Lewer | 169/45 |
| 4,076,862 | 2/1978 | Kobeski et al. | 169/45 X |

FOREIGN PATENT DOCUMENTS

| | | | |
|---|---|---|---|
| 2129462 | 6/1971 | Fed. Rep. of Germany | 169/45 |

*Primary Examiner*—John J. Love
*Assistant Examiner*—Michael Mar
*Attorney, Agent, or Firm*—Strimbeck, Davis & Soloway

[57] ABSTRACT

Apparatus and method for preventing the spontaneous combustion of a stack of stored organic and inorganic substances by injecting a control medium into selected areas of the stack. The apparatus comprises a source of a control medium such as air, steam, combustion gas or a salt solution, and injection nozzles connected to the source of control medium for injecting controlled quantities of the control medium into selected areas of the stack.

16 Claims, 4 Drawing Figures

Figure 1:
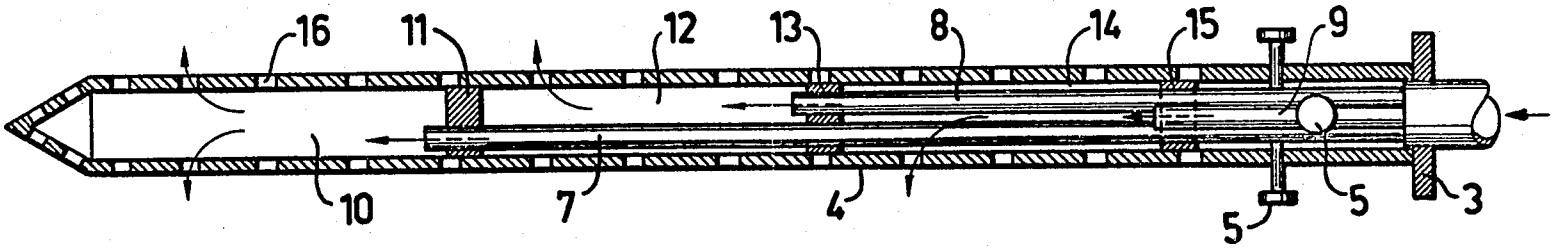

METHOD FOR PREVENTING THE SPONTANEOUS COMBUSTION OF STORED ORGANIC AND INORGANIC SUBSTANCES

This application is a continuation of application Ser. No. 719,928, filed Sept. 2, 1976 now abandoned.

The present invention relates to an apparatus for preventing the spontaneous combustion or self-ignition of organic and inorganic substances, and in particular, but not exclusively, to apparatus for preventing the spontaneous combustion of stored forestry products, such as sawdust, woodchips, wood-waste, peat, stonecoal, woodfibre board and like substances. Fires caused by the self-ignition of such products create damage costing enormous sums of money.

Spontaneous combustion of organic material is a complicated process and in order to take place, a number of conditions must be fulfilled. Although the majority of the conditions under which spontaneous combustion takes place are not as yet completely understood, it is known that all spontaneous combustion processes require an accurately defined environment. The features defining such an environment include suitable heat insulation and a sufficient air supply, although the amount of air required is normally very small. It is also known that the heating process preceding the stage at which the product bursts into flame, i.e. the uncontrolled propagation of an oxidation process, is caused either by thermophilic bacteria or by some form of auto-oxidation process as a result of production processes. The former is true in respect of a number of organic substances, such as sawdust, woodwaste, hay, peat etc., while the latter case is true with respect to a number of other self-combustible materials, such as stonecoal, fibre board, powder iron and iron chips etc. The presence of impurities having a catalytic effect, together with moisture, are also often conditions under which spontaneous combustion is likely to occur.

The aforementioned heat insulation and ventilation, however, are the basic prerequisites that spontaneous combustion shall take place. Normally, the process can be brought to an imbalance and retarded by changing the air supply to the stored materials, i.e. by restricting the air supplied thereto (suffocation) or by increasing said air supply. Normally it is not possible to suffocate the stored material, although it is possible in practice to supply air thereto.

It is known in some instances, such as when storing grain, to feed air to the product being stored, although in this case the intention is simply to dry the product.

The problems of spontaneous combustion is particularly manifest when storing such forestry products as bark, woodchips, pine-needles and green wood for example. These products, which are obtained when trees are fired on a large scale, represent a source of income which has not yet been utilized to the full, since when stored they are highly likely to burst into flames as a result of spontaneous combustion precesses. Because of this it has been stipulated by the Swedish National Nature Conservancy Board that bark, for example, must not be stored in stacks higher than 2,5 m. owing to the fire risk which they represent.

According to the invention there is provided apparatus for controlling the internal conditions of a stack of combustible material, comprising a source of control medium and means connected thereto for injecting said medium into the stack of stored material.

The control medium provided at the source may include air, combustion gas and steam, and additionally a salt solution for admixture with air. Preferably, said means for injecting said medium has the form of at least one tube provided with exit orifices along the length thereof and connectable to the valve means, in which case, said tube may be divided into axially separated chambers, each of which is in communication via a pipe with the valve means, whereby control medium may be fed to the stack selectively through the chambers.

The invention may further comprise temperature-responsive means for insertion into the stack and connectable via control means with said source of control medium, the arrangement being such that the control means is effective via the valve means to cause a selected control medium or mixture thereof to be injected into said stack through said tube, if the temperature level exceeds or falls below a preselected temperature range.

Figure 2:
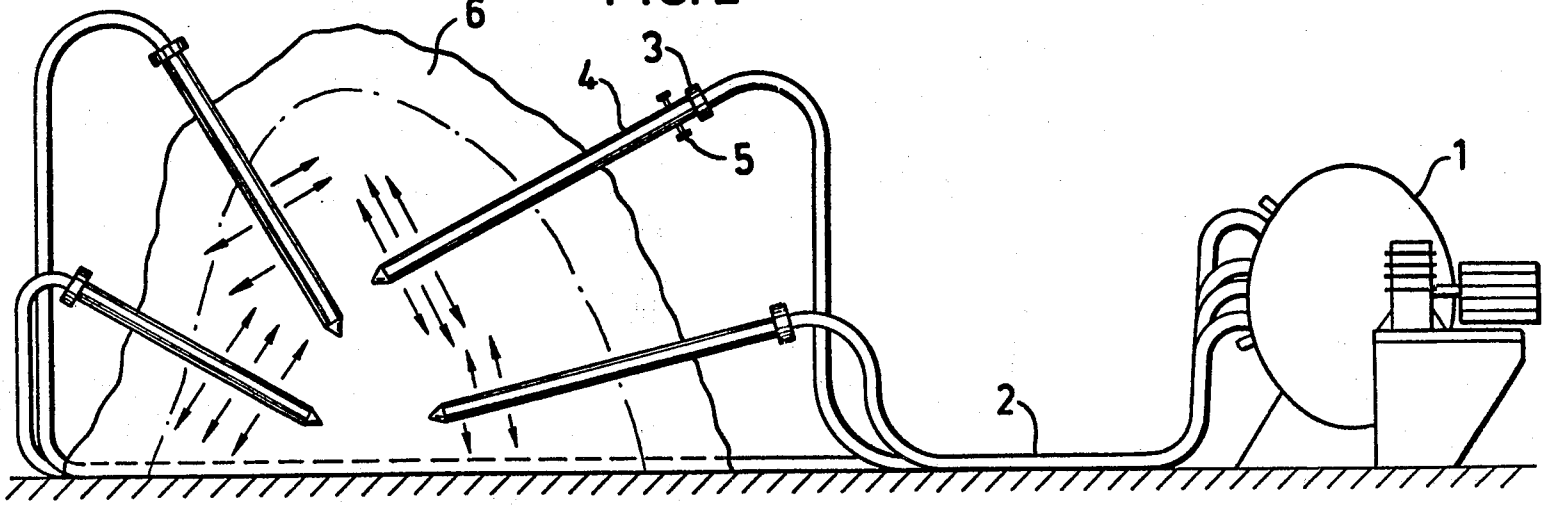

Various objects and further features of the invention will become apparent from the following description, which is made with reference to the accompanying drawings, in which FIG. 1 shows diagrammatically and in section an air-injection nozzle effective, inter alia, to inject air for example into a stored mass of combustible material, FIG. 2 shows diagrammatically four air-injection nozzles connected to a source of air under pressure and inserted in a stack of combustible material.

Figure 3:
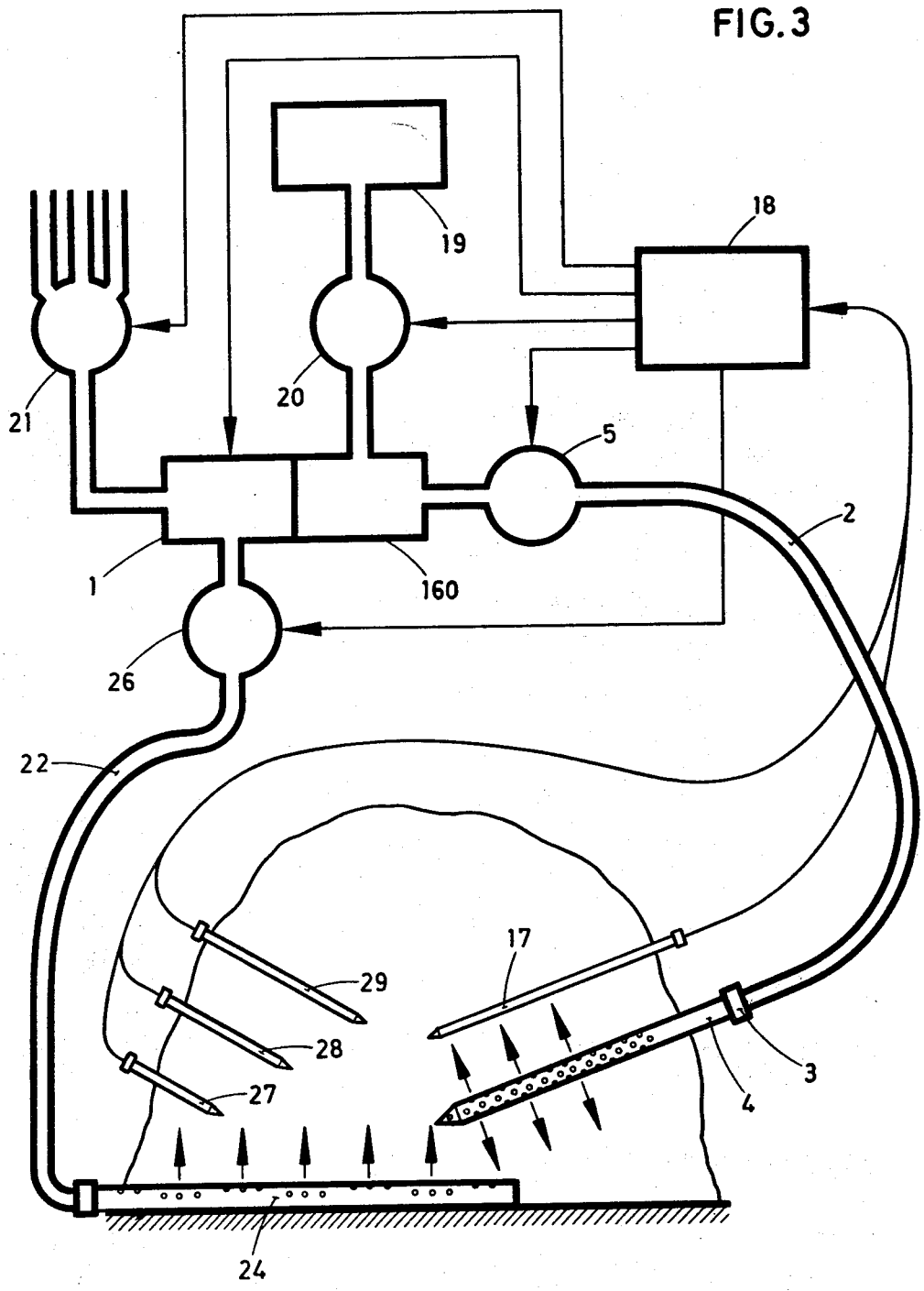
Figure 4:
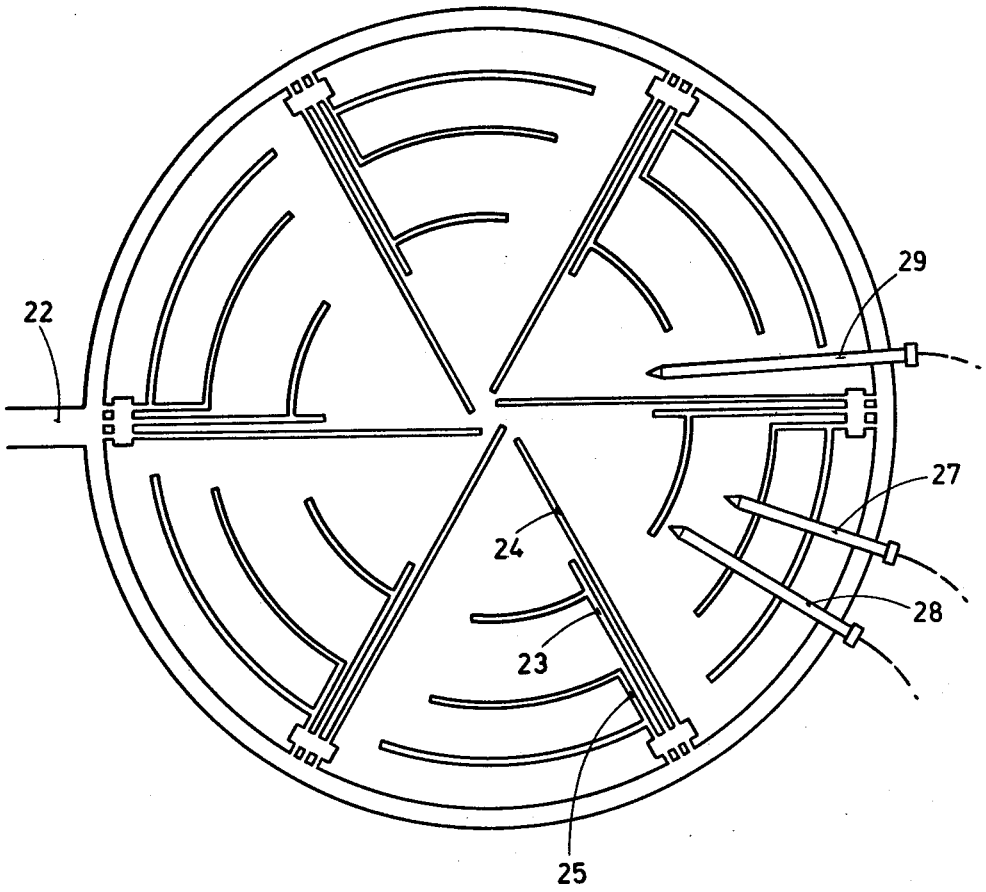

FIG. 3 shows diagrammatically a more detailed view of an apparatus constructed according to the invention, and FIG. 4 shows diagrammatically and in plan view a bottom plate in which a number of injection nozzles are disposed.

Referring now to FIG. 1, there is illustrated an air-injection nozzle 4 having the form of a substantially hollow tube which is pointed at one end thereof. The tube is provided with partitions 11, 13 and 15 which define therebetween respective chambers 10, 12 and 14. Arranged at the end of the air-injection nozzle remote from the pointed end thereof are number of valve means 5, each of which communicates with a respective pipe 7, 8 and 9. As will be seen from FIG. 1, the arrangement is such that the pipe 7 communicates with the chamber 10, the pipe 8 communicates with the chamber 12 and the pipe 9 communicates with the chamber 14. The end of the chamber remote from the wall 13 is closed by a partition 15. Disposed along the length of the nozzle 4 are a number of openings or orifices 16 which communicate with respective chambers 10, 12 and 14.

In FIG. 2, the air-injection nozzles are shown inserted into a stack of combustible material, which may comprise any of the aforementioned combustible products. Each nozzle is connected to a source of air under pressure, which may have the form of a fan or compressor 1, through air hoses 2. The ends of the hoses to be connected to the air-injection nozzles 4 are provided with quick-coupling means 3, thereby to enable the hoses to be readily connected to and disconnected from said nozzles.

The arrangement of the chambers, the pipes communicating therewith and the associated valve means enables respective chambers to be placed under pressure selectively, so that air can be ejected through the orifices 16 of any chamber at will. This enables requirements such as those stipulated by the Swedish Nature Conservancy Board to be complied with, since the air-injection nozzles are merely inserted into the stack so that there is at most a distance of 2,5 meters from the first perforation of the nozzle to the outmost surface of the stack. Conveniently, the air-injection nozzle may comprise sections which can be screwed together to provide nozzles of any desired length.

In practice, the use of such air-injection nozzles has been found effective to prevent the overheating of, for example, stacks of leaf-wood, bark and the like. When prevailing conditions are suitable, air can be injected into the stack at a constant rate for a relatively long period of time.

When the combustible material is stored in containers, such as silos or bunkers, holes may be provided in the silo or bunker walls to accommodate the air-injection nozzles. Since the nozzles can be readily connected to and disconnected from the source of air under pressure, they can easily be removed when it is desired to loosen the material in the container or supply material to or remove material from the same.

Conveniently the air-injection nozzle may be provided with a thermometer, thereby to enable the temperature prevailing in the stack to be checked. When the nozzles are used on a large scale, means may be provided which are responsive to changes in the temperature of the stack so as to open and close the valves, in a manner hereinafter described.

The injection of air into a stack of combustible material is effective to prevent spontaneous combustion. When storing organic substances, however, measures must be taken which are not conducive with the prevention of spontaneous combustion. For example, it may be described to dry the stored material quickly, although an accelerated drying process, or delayed decomposition of the material, for example, which is desirable with certain fibrous materials, gives rise to the aforementioned conditions under which spontaneous combustion may take place. Further, if, in spite of all precautions spontaneous combustion takes place, it is highly desirable that the temperature of the stored material can be brought to a suitable level.

FIG. 3 shows an embodiment of an invention in which the air-injection nozzle of FIG. 1 can be connected to various sources of media whereby conditions within the stack of material stored can be controlled to a greater extent.

In the embodiment of FIG. 3, the source of air under pressure such as a fan 1 is connected to the air-injection nozzles via the air hose 2, a valve 5, which in this instance is remote from the nozzle 4, and a mixer 160. In addition to the air-nozzle 4 there is provided a pointed elongate probe 17 having a temperature-sensitive device and intended to be inserted into the stack 6 generally parallel with and above the air nozzle 4. The temperature-sensitive device may be arranged in a suitable manner along the length of the probe 17, or a single temperature-sensitive device may be arranged on the point thereof. The temperature-sensitive device of the probe 17 is connected to a control means 18 which controls the valve 5, said control means being effective to open and close the valve 5 automatically when the temperature-responsive device detects a temperature which lies above or below a predetermined temperature level respectively. This level is one at which the material stored in the stack will spontaneously combust or become damaged as a result of increased temperatures.

Although the process of spontaneous combustion may be prevented to an extent such that the material does not burst into flames, the temperatures prevailing in the stack may be such as to carbonize the material therein. In accordance with a preferred embodiment of the invention, such carbonization is prevented by admixing with the air injected into the stack a salt solution, which in the illustrated embodiment is contained in a vessel 19 communicating with the mixer 160 through a valve 20, said valve being controlled by the control means 18 connected to the probe 17.

The mixer is provided with an atomizing means (not shown), whereby the salt solution is mixed in the form of minute droplets with the air in the mixer 160 and conveyed into the stack.

The temperature responsive means on the probe 17 may be set so as to cause the salt solution to be atuomatically mixed with the air supplied to the stack when a predetermined temperature is reached therein. Alternatively, manually operated means may be provided whereby the valve 20 can be opened to introduce salt solution into the stack when it is determined that the temperature of the stack is of such magnitude that the injection thereinto of solely air is not sufficient to lower the temperature of the stack within a reasonable period of time.

In accordance with the invention, steam may be passed to the stack 6 so as to hasten decomposition of the material in the stack. In order to dry the material in the stack, it is normal to introduce thereinto a hot or warm combustion gas. In this respect, the steam may be introduced in conjunction with said combustion gas. To this end, the apparatus is provided with a three-way valve 21 which is controlled by the control means 18 and which is connected to the fan 1, and a throttle valve 26 which is controlled by the control means 18 and arranged in a line 22 extending to at least one cylindrical sleeve 24 having a number of orifices disposed along the length thereof, and temperature responsive means 27, 28, 29 similar to the probe 17 associated therewith. As with the probe17, the temperature-responsive means 27, 28 29 are also connected to the control means 18. Referring to FIG. 4, sleeve 24, for injecting steam, combustion gas or air into the stack of material 6 has a number of exit orifices disposed along the length thereof. As will be readily understood, said sleeve may also have the form of an air-injection nozzle, such as the nozzle 4, so that air, combustion gas and steam may selectively be injected into selected portions of the stack.

The combustible material may be stored in boxes, silos, or bunkers. In this case, a number of sleeves 23, 24, 25 may be provided and are preferably cast in a concrete plate, which may comprise the bottom of said box, silo or bunker. Such a bottom plate is illustrated in FIG. 4 and it will be apparent therefrom that the sleeves 23 and 24 have arcuate extensions so as to provide for selective injection into the stack over a substantial bottom area.

When desiring to hasten the decomposition of the material in the stack 6, the valve 21 is closed so that the fan 1 supplies steam to the sleeves 25, 23, 24. Should it be observed through the means 27, 28, 29 that the temperature of the stack has risen to an impermissible value, the control means 18 is adjusted so that fresh air is supplied to the stack by the fan 1.

Alternatively, if it is desired to accelerate the drying of the material in the stack, the valve 21 is adjusted so as to supply the fan with combustion gas, which is injected into the stack through the valve 26, the line 22 and the sleeve 24. In an analoguous manner, an adjustment can be made so that air is injected into the stack, should the temperature rise to impermissible values.

The invention thus provides within its scope apparatus in which an appropriate medium can be readily injected into a stack or combustible material in dependance upon the internal conditions of the stack and thereby provide corrective treatment to the stack.

I claim:

1. A method for controlling conditions within the interior of a stack of combustible solid materials so as to prevent spontaneous combustion of said materials, said method comprising the steps of:

(1) sensing the temperature of selected areas within said stack; and (2) injecting a control medium into those of said selected areas of said stock in which temperature falls without a preselected temperature range so as to modify the environment within said selected areas, said control medium being injection into selected areas in said stack via at least one delivery tube means inserted into said stack, said tube means (a) being divided into a number of axially separated chambers, and (b) having a number of exit orifices over at least part of its length which communicate with respective of said chambers and including pipe means connecting each of said chambers to a source of said control medium, and a valve means associated with each chamber of said delivery tube means, and including the step of controlling said valve means whereby to feed said control medium into said selected areas in said stack.

2. A method according to claim 1 wherein said control medium is selected from the group consisting of: air, a salt solution, steam, a combustion gas, and a mixture of at least two of said group.

3. A method according to claim 2 wherein said control medium comprises a mixture of air and a salt solution.

4. A method according to claim 2 wherein said control medium comprises a mixture of air and steam.

5. A method according to claim 2, wherein said control medium comprises a mixture of air and a combustion gas.

6. A method according to claim 2, wherein said control medium comprises air.

7. A method according to claim 2, wherein said control medium comprises a combustion gas.

8. A method according to claim 2, wherein said control medium comprises steam.

9. A method for controlling conditions within the interior of a stack of combustible solid materials so as to prevent spontaneous combustion of said materials, said method comprising the steps of:

(1) sensing the temperature of selected areas within said stack, and (2) injecting a control medium into those of said selected areas of said stack in which the temperature exceeds or falls below a preselected temperature range so as to modify the environment within said selected areas, said control medium being injected into selected areas in said stack via at least one delivery tube means inserted into said stack, said tube means (a) being divided into a number of axially separated chambers, and (b) having a number of exit orifices over at least part of its length which communicate with respective of said chambers, and including pipe means connecting each of said chambers to a source of said control medium, and a valve means associated with each chamber of said delivery tube means, and including the step of controlling said valve means whereby to feed said control medium into said selected areas in said stack.

10. A method according to claim 9 wherein said control medium is selected from the group consisting of: air, a salt solution, steam, a combustion gas, and a mixture of at least two of said group.

11. A method according to claim 10 wherein said control medium comprises a mixture of air and a salt solution.

12. A method according to claim 10 wherein said control medium comprises a mixture of air and steam.

13. A method according to claim 10, wherein said control medium comprises a mixture of air and a combustion gas.

14. A method according to claim 10, wherein said control medium comprises air.

15. A method according to claim 10, wherein said control medium comprises a combustion gas.

16. A method according to claim 10, wherein said control medium comprises steam.

* * * * *